US009223249B2

(12) United States Patent
Shimada et al.

(10) Patent No.: US 9,223,249 B2
(45) Date of Patent: Dec. 29, 2015

(54) IMAGE FORMING UNIT AND IMAGE FORMING APPARATUS

(71) Applicant: Oki Data Corporation, Tokyo (JP)

(72) Inventors: Shingo Shimada, Tokyo (JP); Tetsu Koyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/551,137

(22) Filed: Nov. 24, 2014

(65) Prior Publication Data

US 2015/0147097 A1 May 28, 2015

(30) Foreign Application Priority Data

Nov. 28, 2013 (JP) ..... 2013-245657

(51) Int. Cl.
*G03G 15/08* (2006.01)

(52) U.S. Cl.
CPC .... *G03G 15/0889* (2013.01); *G03G 2215/0141* (2013.01)

(58) Field of Classification Search
CPC ..... G03G 15/0887; G03G 15/0889; G03G 2215/085
See application file for complete search history.

(56) References Cited

U.S. PATENT DOCUMENTS

2007/0177899 A1* 8/2007 Kawamura ..... 399/223
2009/0060588 A1* 3/2009 Tanaka ..... 399/263
2009/0297178 A1* 12/2009 Kakuta et al. ..... 399/27

FOREIGN PATENT DOCUMENTS

JP 2011-099894 A 5/2011

* cited by examiner

*Primary Examiner* — Gregory H Curran
(74) *Attorney, Agent, or Firm* — Panitch Schwarze Belisario & Nadel LLP

(57) ABSTRACT

An image forming unit includes an image carrier, a developer carrier carrying a developer for developing images by attaching the developer to electrostatic latent images on the image carrier, a developer supply member for supplying the developer to the developer carrier, a first developer container having an opening, for containing the developer, a second developer container reserving the developer supplied via the opening from the first developer container, and a stirring member disposed rotatably in a prescribed rotation direction around a rotation axis in the first developer container for stirring the developer. The stirring member comprises a first elastic member extending in a first direction, and a second elastic member extending in a second direction as different direction from the first direction, and the second elastic member is disposed on a downstream side of the first elastic member in the rotation direction of the stirring member.

20 Claims, 7 Drawing Sheets

IMAGE FORMING UNIT AND IMAGE FORMING APPARATUS

CROSS REFERENCE TO RELATED APPLICATION

This application claims priority benefits under 35 USC, section 119 on the basis of Japanese Patent Application No. 2013-245657, the disclosure of which is incorporated herein by reference.

BACKGROUND OF THE INVENTION

1. Field of the Invention

This invention relates to an image forming unit and an image forming apparatus.

2. Description of Related Art

Image forming apparatuses such as printers, photocopiers, and facsimile machines, as exemplified by printers, conventionally include respective image forming units for black, cyan, magenta, and yellow, and LED heads, transfer units, and fixing devices, which are disposed corresponding to the respective image forming units. The image forming unit, each includes, such as, e.g., a photosensitive drum, a charge roller, a developing device, a cleaning blade, a toner container containing toner as a developer.

The developing device includes such as, e.g., a toner reservoir for temporarily reserving a toner supplied from the toner container, a developing roller disposed at the toner reservoir, a developing blade, and a toner supply roller. The toner reserved at the toner reservoir is supplied to the developing roller by the toner supply roller, and is made to a thin layer with the developing blade to form toner images. In the printers, the surface of the photosensitive drum uniformly charged with the charge roller is exposed by the LED heads to form electrostatic latent images, and the toner on the developing roller is attached to the electrostatic latent images. The electrostatic latent images are developed, and toner images are formed on the photosensitive drum. Subsequently, the toner images are transferred onto a paper by the transfer roller of the transfer unit, and are fixed to the paper with the fixing device to form images on the paper.

With a printer in which respective image forming units are detachably attached to a body of the printer, or namely an apparatus body, the toner is consumed as repeating image formations, and if the toner in the toner container is consumed totally, the image forming unit should be replaced with a bland new one.

In such an image forming apparatus, a stirring member is installed for stirring the toner in the toner reservoir (see, e.g., Japanese Application Publication No. 2011-99894 (A1)).

The image forming unit thus structured is required to have a stable toner stirring performance.

SUMMARY OF THE INVENTION

As one aspect of the invention, an image forming unit comprising: an image carrier; a developer carrier carrying a developer for developing images by attaching the developer to electrostatic latent images on the image carrier; a developer supply member for supplying the developer to the developer carrier; a first developer container having an opening, for containing the developer; a second developer container reserving the developer supplied via the opening from the first developer container; and a stirring member disposed rotatably in a prescribed rotation direction around a rotation axis in the first developer container for stirring the developer, wherein the stirring member comprises a first elastic member extending in a first direction, and a second elastic member extending in a second direction as different direction from the first direction, the second elastic member disposed on a downstream side of the first elastic member in the rotation direction of the stirring member.

BRIEF DESCRIPTION OF THE DRAWINGS

The above and other objects and features of the present invention will become apparent from the following detailed description and the appended claims with reference to the accompanying drawings.

DETAILED DESCRIPTION OF EMBODIMENTS

Figure 1:
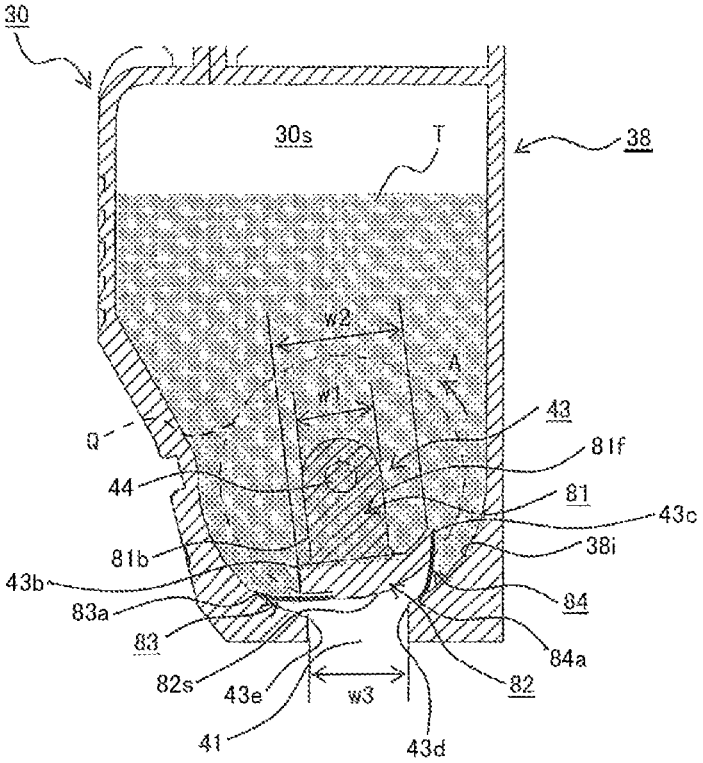
FIG. 1 is a cross-sectional diagram showing a toner container according to an embodiment of the invention.

Referring to the drawings, embodiments of affixing device and an image forming apparatus according to this invention are described. In this embodiment, a multicolor printer is exemplified as an image forming apparatus.

Figure 2:
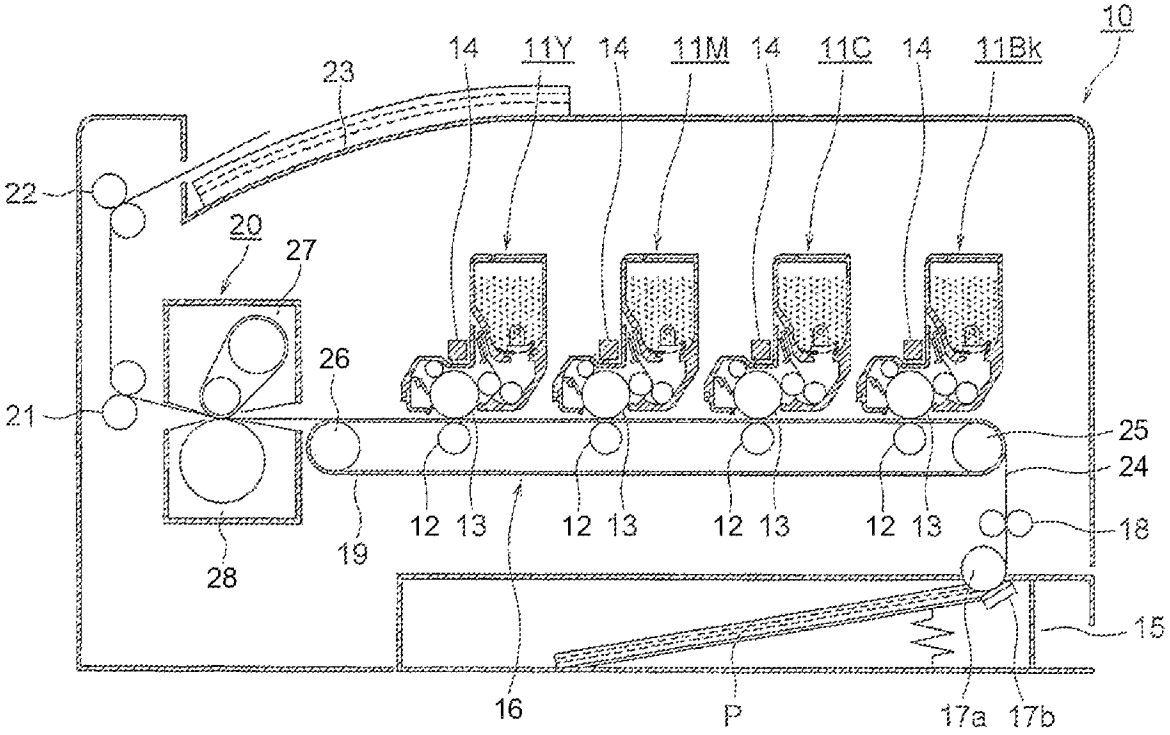
FIG. 2 is an illustration showing a printer according to the embodiment of the invention.
Figure 3:
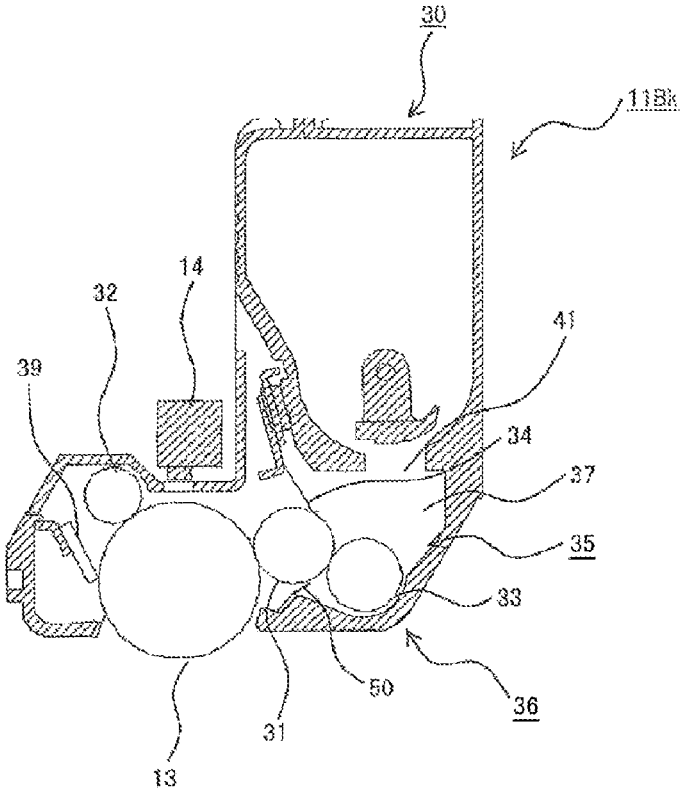
FIG. 3 is a cross-sectional diagram showing an image forming unit according to the embodiment of the invention.

FIG. 2 is an illustration showing a printer according to the embodiment of the invention; FIG. 3 is a cross-sectional diagram showing an image forming unit according to the embodiment of the invention. It is to be noted that FIG. 3 shows an image forming unit 11Bk described below, among image forming units 11Bk, 11C, 11M, 11Y.

In FIG. 2, a multicolor printer 10 is exemplified as an image forming apparatus. The printer 10 includes, e.g., four color image forming units 11Bk, 11C, 11M, 11Y for black, cyan, magenta, yellow to form multicolor images, a transfer unit 16 arranged below the image forming units 11Bk, 11C, 11M, 11Y as extending along the image forming units 11Bk, 11C, 11M, 11Y, four LED heads 14 serving as exposing devices respectively disposed at the image forming units 11Bk, 11C, 11M, 11Y each facing a corresponding photosensitive drum 13 serving as an image carrier, a paper cassette 15 serving as a medium container containing paper P as media disposed below the transfer unit 16, and a fixing device 20 serving as a fixing apparatus.

A paper feeding mechanism is arranged adjacently to a front end of the paper cassette 15 for feeding paper P sheet by sheet in a separating manner. The paper feeding mechanism includes such as, e.g., a hopping roller 17*a* serving as a feeding member, and a separator 17*b*.

The paper P fed by the paper feeding mechanism is conveyed through a medium conveyance route 24 by a conveyance roller pair 18 to be sent between the image forming units 11Bk, 11C, 11M, 11Y and the transfer unit 16. The paper P is further conveyed to the fixing device 20 and then conveyed by a conveyance roller pair 21 to be delivered to the exterior of the body of the printer 10, or namely, the apparatus body, by a delivery roller pair 22, thereby being stacked on a stacker 23.

The image forming units 11Bk, 11C, 11M, 11Y are detachably arranged to the apparatus body sequentially from an upstream side to a downstream side in the medium conveyance route 24. Toner images as developer images are formed respectively in black, cyan, magenta, and yellow at the image forming units 11Bk, 11C, 11M, 11Y, respectively.

Each of the image forming units 11Bk, 11C, 11M, 11Y therefore has a toner container 30 as a first developer container containing toner as a developer of the respective color arranged at an upper portion. Each of the image forming units 11Bk, 11C, 11M, 11Y further includes such as, e.g., a charge roller 32 disposed in contact with the photosensitive drum 13 at a periphery of the photosensitive drum 13 serving as a charge device for charging uniformly a surface of the photosensitive drum 13, a developing device 35 disposed facing the photosensitive drum 13 serving as a developing apparatus forming toner images on the surface of the photosensitive drum 13, and a cleaning blade 39 disposed in contact with the photosensitive drum 13 for scraping and removing remaining toner on the photosensitive drum 13 after the toner images are transferred onto the paper P.

The LED head 14 selectively exposes the surface of the photosensitive drum 13 charged uniformly with the charge roller 32, thereby forming electrostatic latent images as latent images.

The developing device 35 includes such as, e.g., a toner hopper 37 arranged at a lower side of the toner container 30 serving as a second developer reservoir temporarily reserving the toner supplied from the toner container 30 and as a toner reservoir, a developing roller 31 serving as a developing element disposed at the toner hopper 37 or namely as a developer carrier carrying the toner and attaching toner to the electrostatic latent images as disposed in contact with the photosensitive drum 13 in this embodiment, a toner supply roller 33 disposed in contact with the developing roller 31 serving as a developer supply member supplying to the developing roller 31 the toner supplied from the toner container 30, and a developer blade 34 disposed as its tip contacts the developing roller 31 serving as a developer limiting member for making the toner into a thin layer on the developing roller 31. A toner supply opening 41 is formed as an opening as well as a developer supply inlet at a lower end of the toner container 30, and the toner in the toner container 30 is supplied to the toner hopper 37 via the toner supply opening 41.

It is to be noted that a sealing member 50 is attached to a lower frame 36 of each of the image forming units 11Bk, 11C, 11M, 11Y and seals a space between the inside and the outside of the image forming units 11Bk, 11C, 11M, 11Y as rendering its tip contact the developing roller 31.

The transfer unit 16 includes such as, e.g., a drive roller 25 serving as a first transfer roller, a driven roller 26 serving as a second transfer roller, a transfer belt 19 tensioned in a readily proceeding manner by means of the drive roller 25 and the driven roller 26 for conveying the paper P in accompany with the proceeding, and transfer rollers 12 arranged facing the photosensitive drums 13, respectively, via the transfer belt 19. A transfer portion is formed between the photosensitive drum 13 of the image forming units 11Bk, 11C, 11M, 11Y and the transfer roller 12, and the toner images in the respective colors are transferred onto the paper P in a sequentially overlapping manner to form multicolor images.

The fixing device 20 includes a heating belt unit 27 as a heating element, and a pressure roller 28 as a pressure element, thereby fixing multicolor toner images transferred to the paper P onto the paper P to form the multicolor images.

In operation of the printer 10 thus structured, first, when a printing instruction is given, a drive motor, not shown, as a drive unit for image formation provided in the apparatus body, is driven, thereby rotating the photosensitive drums 13, the developing rollers 31, the charge rollers 32, and the toner supply rollers 33, which are connected via the first rotation transmission system such as a gear train. A power supply device, not shown, provided in the apparatus body applies a voltage to the charge roller 32, thereby charging uniformly the surface of the photosensitive drum 13. According to the rotation of the photosensitive drum 13, when a charged portion on the photosensitive drum 13 reaches a position facing the LED head 14, the LED head 14 exposes the photosensitive drum 13 to emitted light, thereby forming electrostatic latent images on the surface of the photosensitive drum 13. When the portion formed with the electrostatic latent images on the photosensitive drum 13 reaches the position facing the developing device 35, the developing device 35 attaches the toner to the electrostatic latent images, thereby developing the electrostatic latent images to form the toner images.

To the contrary, when a feeding motor, not shown, serving as a drive unit for feeding media is driven, the paper P contained in the paper cassette 15 is fed to the medium conveyance route 24 by the hopping roller 17*a*, then conveyed by the conveyance roller pair 18, and sent to the portion between the image forming units 11Bk, 11C, 11M, 11Y and the transfer unit 16.

Then, when the paper P is sent to respective transfer portions along proceeding of the transfer belt 19, and when a portion at which the toner images are formed on the photosensitive drum 13 reaches the transfer portion, a voltage is applied to respective transfer roller 12, and the toner images in respective colors are transferred onto the paper P sequentially by means of the transfer rollers 12, thereby forming multicolor toner images.

The paper P is sequentially sent to the fixing device 20 according to proceeding of the transfer belt 19. The multicolor toner images are heated and pressed at the fixing device 20 to be fixed to the paper P, thereby forming multicolor images.

The paper P formed with the multicolor images is conveyed by the conveyance roller pair 21, delivered to the exterior of the apparatus body by the delivery roller pair 22, and stacked on the stacker 23.

Figure 4:
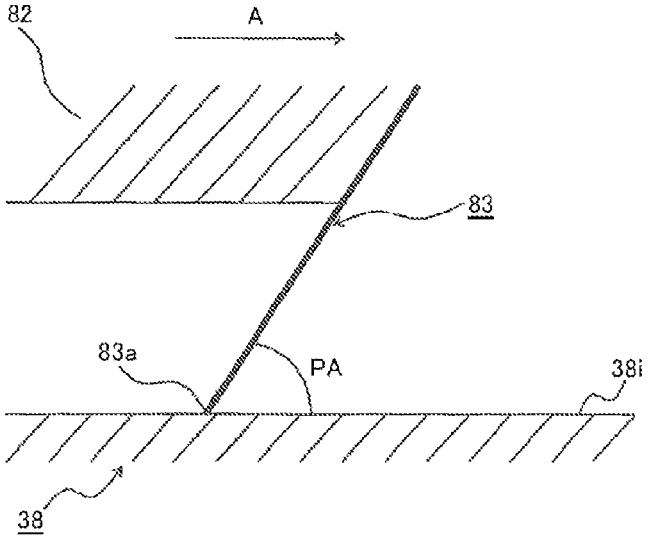
FIG. 4 is a diagram illustrating an attaching method of sealing members according to the embodiment of the invention.
Figure 10:
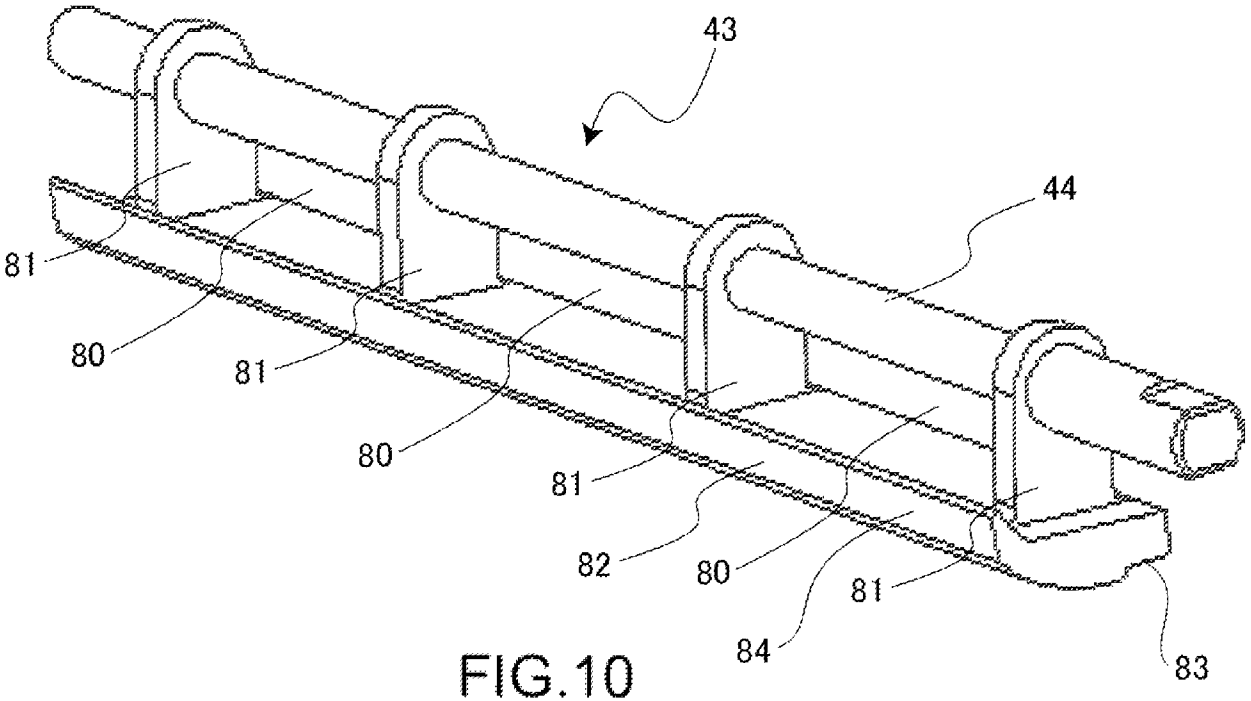
FIG. 10 is a perspective schematic view showing a stirring member according to the embodiment of the invention.

Next, the toner container 30 is described. FIG. 1 is a cross-sectional diagram showing a toner container according to an embodiment of the invention; FIG. 4 is a diagram illustrating an attaching method of sealing members according to the embodiment of the invention. FIG. 10 is a perspective schematic view showing a stirring member according to the embodiment of the invention.

In FIG. 1, the toner container 30 includes a developer containing space 30*s* formed with an outer frame 38, a toner supply opening 41, and a stirring member 43. The stirring member 43 serves as a shielding member arranged rotatably in Arrow A direction at a prescribed position in the developer containing space 30*s* or namely, in this embodiment, immediately above the toner supply opening 41, for stirring the toner T according to its rotation and for opening and closing the toner supply opening 41.

The toner supply opening 41 is formed at a prescribed position, such as, e.g., a center portion in a longitudinal direction of the outer frame 38, or namely in a depth direction of the paper surface of FIG. 1, and has a shorter length in the longitudinal direction of the outer frame 38 than the length of the outer frame 38.

The stirring member 43 is arranged as extending in the longitudinal direction of the outer frame 38 and includes a rotation axis 44 as a rotation center of the stirring member 43, arm portions 81 attached to the rotation axis 44 and formed as extending radially outward from the rotation axis 44, a shielding portion 82 formed as extending in the rotation direction of the stirring member 43 at tips of the arm portions 81 in a curving manner, and sealing members 83, 84 serving as a pair or first and second of elastic members attached to ends on upstream and downstream sides of the shielding portion 82, respectively, in the rotation direction of the stirring member 43, made of a resin in a film form such as PET (polyethylene terephthalate) film or the like in this embodiment.

The arm portion 81 is formed with a back wall 81*b* and a front wall 81*f* formed parallel to each other as extending in the radial direction on the upstream and downstream sides in the rotation direction of the stirring member 43. A width w1 of the arm portion 81, or namely a distance between the back wall 81*b* and the front wall 81*f*, is set to be a constant in the radial direction of the arm portion 81. The length of the arm portion 81 in the longitudinal direction of the outer frame 38 is set longer than the length of the toner supply opening 41.

In FIG. 10, the arm portions 81 are provided in a plural number along the axial direction of the rotational axis 44 of the stirring member 43. Openings 80 are formed with the shielding portion 82 and with the arm portions 81 located adjacent to each other in the axial direction of the rotation axis 44. The openings 80 are also formed in the plural number along the axial direction of the rotational axis 44 of the stirring member 43. The sealing members 83, 84 are attached to ends on upstream and downstream sides of the shielding portion 82, respectively, in the rotation direction of the stirring member 43.

In the rotation direction of the stirring member 43, the sealing member 83 serving as the first elastic member and the sealing member 84 serving as the second elastic member extend respectively in different directions. With this structure, the sealing members 83, 84 produce different pushing forces to the inner wall 38*i* of the toner container 30 when the toner T is stirred. The sealing member 84 has strong pushing force and can break agglomerated toner into small toner particles whereas the sealing member 83 can smooth the toner particles with weak pushing force. With this operation, the stirring member 43 enhances the stirring performance remarkably. The sealing member 83 is disposed on a downstream side of the sealing member 84 in a "toner flow" direction as the direction opposite to the rotational direction of the stirring member 43, so that the sealing member 83 can efficiently smooth the agglomerated toner after broken. The sealing member 83 and the sealing member 84 are arranged as to extend in directions substantially perpendicular to each other, so that such advantages of grinding into smaller particles and averaging the toner are readily obtainable with the stirring member 43. In this specification, the term "substantially perpendicular" means a range of such as 80 to 110 degrees, and in this embodiment, the angle is set to 83 degrees.

The shielding portion 82 is formed in an arch-like curving manner in having a block with a prescribed thickness. An outer peripheral surface 82*s* of the shielding portion 82 has a contour extending along a trace Q (rotational outer periphery) depicted by the tip of the stirring member 43 in the radial direction, or namely by the shielding member 82 and the sealing members 83, 84, when the stirring member 43 rotates. A width w2 of the shielding portion 82, or namely the distance between an end 43*c* on a downstream side and an end 43*b* on an upstream side of the stirring member 43 in the rotational direction, is designed larger than a width w3 of the toner supply opening 41, or namely the distance between an edge 43*e* on an upstream side and an edge 43*d* on a downstream side in the rotational direction of the stirring member 43 facing an inner edge of the toner supply opening 41. The length of the shielding portion 82 in the longitudinal direction of the stirring member 43 is designed the same as the length of the arm portions 81, and designed longer than the length of the toner supply opening 41.

A sliding area is formed having an arc shape near the toner supply opening 41 on the inner wall 38*i* of the outer frame 38 in extending around an angle of 180 degrees as corresponding to a lower half portion of the trace Q. The stirring member 43 renders the outer peripheral surface 82*s* of the shielding portion 82 face the inner wall 38*i*, renders tips 83*a*, 84*a* of the sealing members 83, 84 contact the inner wall 38*i*, and is rotated as the sealing members 83, 84 are bent.

The sealing members 83, 84 are made to have the same area size as each other, and are attached to the shielding portion 82 so that the tips 83*a*, 84*a* contact the inner wall 38*i* of the outer frame 38 as extending in a forward direction with respect to the rotational direction of the stirring member 43. The length of the sealing members 83, 84 in the longitudinal direction of the outer frame 38 is set to approximately the same length as the shielding portion 82 and is set longer than the length of the toner supply opening 41. As shown in FIG. 4, where the shielding portion 82 is moved (rotated) in arrow A direction with respect to the outer frame 38 as the tip 83*a* of the sealing member 83 is in contact with the inner wall 38*i* of the outer frame 38, and where an angle PA made between the sealing member 83 and a portion on a downstream side of the tip 83*a* on the inner wall 38*i* in the moving direction of the shielding portion 82 is set to PA<90 degrees, the sealing member 83 is provided as the tip 83*a* is contacting in a forward direction to the inner wall 38*i* of the outer frame 38 with respect to the rotational direction of the stirring member 43.

In this embodiment, the term "substantially the same area size" means that an area size of one is in a range of an area side of another plus and minus 10%. The term "substantially the same length" means that a length of one is in a range of a length of another plus and minus 10%.

The stirring member 43 closes the toner supply opening 41 when the shielding portion 82 is located at a position facing the toner supply opening 41. At that time, the tip 83*a* of the sealing member 83 is located on an upstream side of the edge 43*e* of the toner supply opening 41 whereas the tip 84*a* of the sealing member 84 is located on a downstream side of the edge 43*d* of the toner supply opening 41. The toner T in the toner container 30 is therefore prevented from being supplied into the toner hopper 37 (see, FIG. 3) through a gap between the outer peripheral surface 82*s* of the shielding portion 82 and the inner wall 38*i* of the outer frame 38. As a result, the toner T in the toner hopper 37 may not come to leak out of the image forming units 11Bk, 11C, 11M, 11Y through a gap between a tip of the sealing member 50 and the developing roller 31.

Where the shielding portion 82 is placed to the sliding area, the gap between the outer peripheral surface 82*s* of the shielding portion 82 and the inner wall 38*i* of the outer frame 38 is set to 1 mm; the thickness of the sealing members 83, 84 is set to 0.05 mm; and the sealing members 83, 84 are bent around 1 mm in a state that the tips 83*a*, 84*a* are in contact with the inner wall 38*i*.

Figure 5:
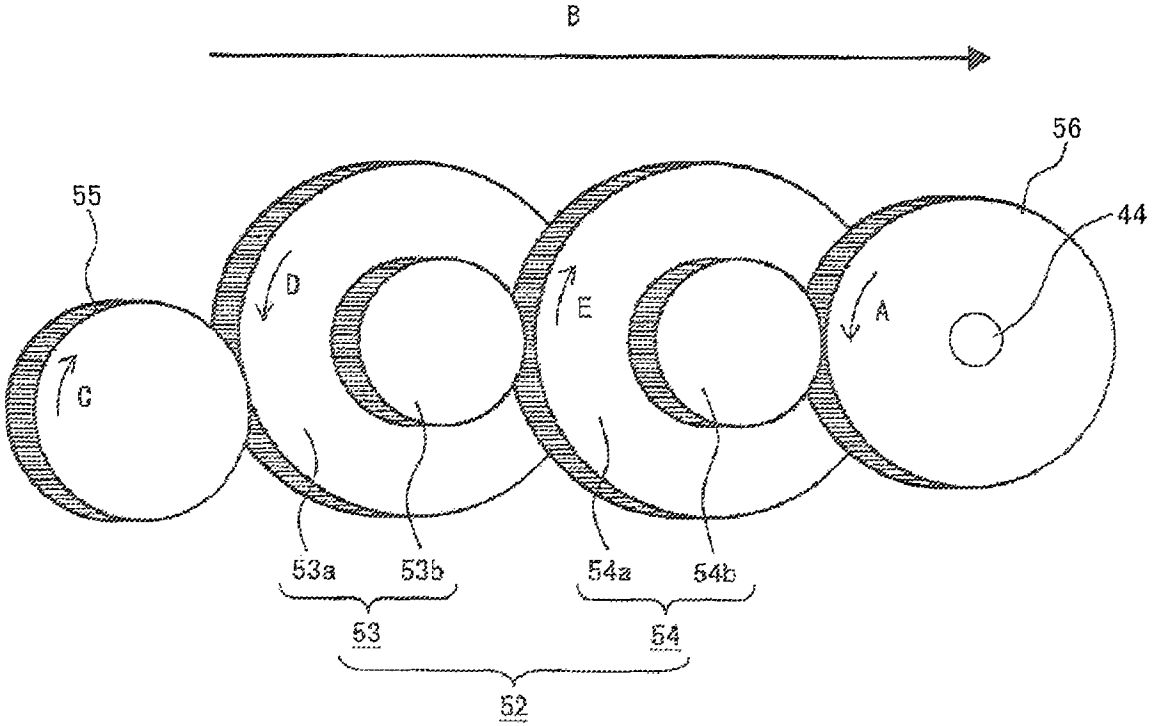
FIG. 5 is an illustration showing a second rotation transmission system according to the embodiment of the invention.
Figure 6:
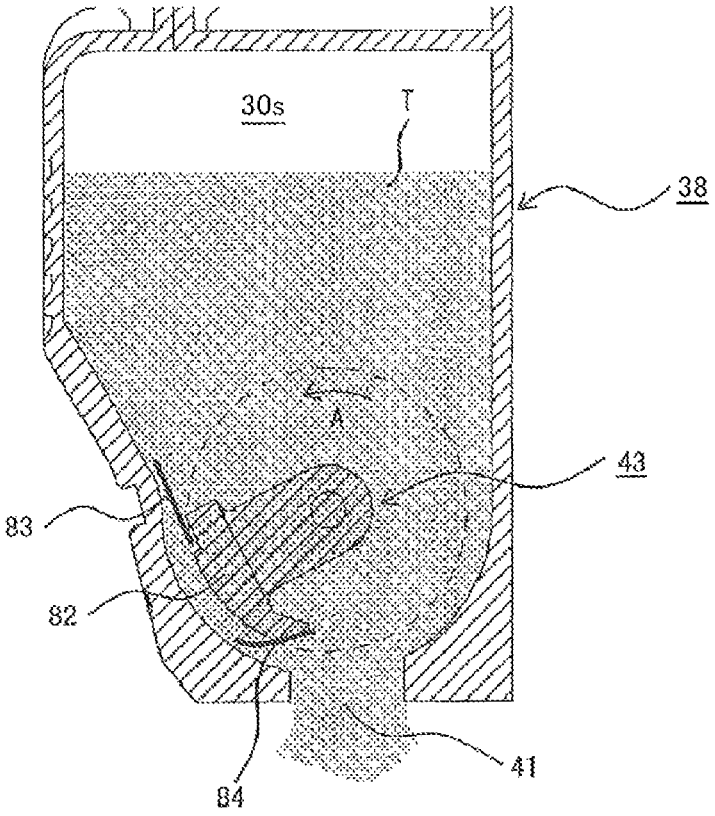
FIG. 6 is a cross-sectional diagram showing the toner container, when a toner supply opening is released according to the embodiment of the invention.

Next, a second rotation transmission system for transmitting the rotation of the stirring member 43 is described. FIG. 5 is an illustration showing a second rotation transmission system according to the embodiment of the invention; FIG. 6 is a cross-sectional diagram showing the toner container, when a toner supply opening is released according to the embodiment of the invention.

In FIG. 5, a drive gear 55 is attached to an end of the photosensitive drum 13 (see, FIG. 2) and is serving as a first gear transmitting rotation of the drive motor to the photosensitive drum 13. A driven gear 56 is attached to an end of the rotational axis 44 of the stirring member 43 and is serving as a second gear transmitting rotation of the drive motor to the stirring member 43. A reduction drive mechanism 52 is provided between the drive gear 55 and the driven gear 56 for reducing the speed of the rotation transmitted to the gear 55 and for transmitting the rotation to the driven gear 56. It is to be noted that arrow B depicts a transmitting direction of the rotation in this second rotation transmission system.

The reduction drive mechanism 52 includes double gears 53, 54 as first and second speed reduction gears for reducing rotation speed with two speeds. The double gear 53 has a large diameter gear 53*a* and a small diameter gear 53*b*, which are arranged coaxially as a united body. The double gear 54 has a large diameter gear 54*a* and a small diameter gear 54*b*, which are arranged coaxially as a united body. The drive gear 55 meshes the large diameter gear 53*a* of the double gear 53; the small diameter gear 53*b* of the double gear 53 meshes the large diameter gear 54*a* of the double gear 54; the small diameter gear 54*b* of the double gear 54 meshes the driven gear 56.

The diameter of the large diameter gear 53*a* is set larger than the diameter of the drive gear 55; the diameter of the large diameter gear 54*a* is set larger than the diameter of the small diameter gear 53*b*; the diameter of the driven gear 56 is set larger than the diameter of the small diameter gear 54*b*.

When the drive motor is driven, the rotation of the drive motor is transmitted to the drive gear 55 to rotate the drive gear 55 in Arrow C direction, and the rotation speed of the drive gear 55 is reduced and transmitted to the large diameter gear 53*a* of the double gear 53, thereby rotating the double gear 53 in Arrow D direction. The rotation speed of the small diameter gear 53*b* of the double gear 53 is reduced and transmitted to the large diameter gear 54*a* of the double gear 54, thereby rotating the double gear 54 in Arrow E direction. The rotation speed of the small diameter gear 54*b* of the double gear 54 is reduced and transmitted to the driven gear 56, thereby rotating the driven gear 56 in Arrow A direction.

Where the drive gear 55 is rotated in Arrow C direction as described above, the photosensitive drum 13 is rotated in the same direction as the drive gear 55, or namely in Arrow C direction, whereas the driven gear 56 is rotated in the opposite direction, or namely in Arrow direction, and the stirring member 53 is rotated in the same direction as the driven gear 56, or namely in Arrow A direction.

Accordingly, where the respective image forming units 11Bk, 11C, 11M, 11Y are in a brand new or unused state, if an operator sets the image forming units 11Bk, 11C, 11M, 11Y to the apparatus body and turns power on to drive the drive motor, the rotation is transmitted from the drive motor to the photosensitive drum 13, and rotation transmitted to the photosensitive drum 13 is reduced by the reduction drive mechanism 52 and transmitted to the stirring member 43. The stirring member 43 is rotated in Arrow A direction as shown in FIG. 6, and the shielding portion 82 is placed to a position not facing the toner supply opening 41, thereby releasing the toner supply opening 41.

As a result, the toner T in the developer containing space 30*s* is supplied to the toner hopper 37 via the toner supply opening 41. In addition, according to rotation of the stirring member 43 in Arrow A, the toner T is pushed toward the toner supply opening 41 by the sealing members 83, 84, so that the toner T can be smoothly supplied to the toner hopper 37.

It is to be noted that the sealing members 83, 84 have the same area size, but the sealing member 83 extends in a direction substantially parallel to a direction that the shielding portion 82 extends, whereas the sealing member 84 extends in a direction substantially parallel to a direction that the arm portions 81 extend.

The distance between a center line between the back wall 81*b* and the front wall 81*f* of the arm portions 81 and the tip 83*a* of the sealing member 83 becomes longer than the distance between the center line and the tip 84*a* of the sealing member 84, so that force F1 that the sealing member 83 receives from the toner T becomes stronger than force F2 that the sealing member 84 receives from the toner T, and so that force pushing the stirring member 43 in Arrow A direction is generated from the difference ΔF between the force F1 and the force F2. Consequently, backrush in meshing the respective gears in the second rotation transmission system can be absorbed, so that the rotation of the stirring member can be made stable. Furthermore, the toner T in the toner container 30 can be surely prevented from being supplied into the toner hopper 37 via the gap between the outer peripheral surface 82*s* of the shielding portion 82 and the inner wall 38*i* of the outer frame 38.

In a state that the respective image forming units 11Bk, 11C, 11M, 11Y are brand new, the shielding portion 82 is placed to the position facing the toner supply opening 41, so that the stirring member 43 is positioned in a state closing the toner supply opening 41.

The term "brand new state" of the image forming units 11Bk, 11C, 11M, 11Y means a state that after the image forming units 11Bk, 11C, 11M, 11Y are attached to the apparatus body, the power is not yet turned on at the apparatus body, or that the image forming units 11Bk, 11C, 11M, 11Y are manufacture and are not yet activated after the shipment is made from the factory.

In this situation, the stirring member 43 is connected to the reduction drive mechanism 52 and the drive gear 55 via the driven gear 56, but the stirring member 43 may not rotate according to inertia moment of the respective gears even where vibrations or the like are exerted to the image forming units 11Bk, 11C, 11M, 11Y as in a situation that the image forming units 11Bk, 11C, 11M, 11Y in a brand new state are loaded, because each gear is made to cease.

The stirring member 43 further may not rotate because a large torque according to respective gears of the driven gear 56, the reduction drive mechanism 52, and the drive gear 55, particularly a reduction ratio in the reduction drive mechanism 52, is required to rotate the stirring member 43. It is to be noted that in this embodiment, the reduction drive mechanism 52 in the brand new state prevents the stirring member 43 from rotating and serves as a closing state keeping apparatus for keeping the stirring member 43 to be in a state closing the toner supply opening 41.

Next, a method for distinguishing open and closed states of the toner supply opening 41 at the toner container 30 of the image forming units 11Bk, 11C, 11M, 11Y is described.

Because the image forming units 11Bk, 11C, 11M, 11Y have the same structure, the description is made only to the image forming unit 11Bk herein.

Figure 7:
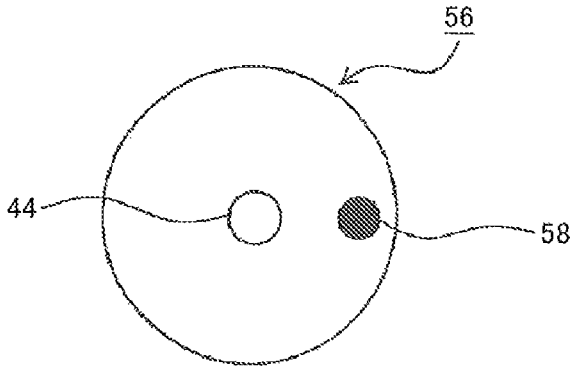
FIG. 7 is a front view showing a driven gear according to the embodiment of the invention.
Figure 8:
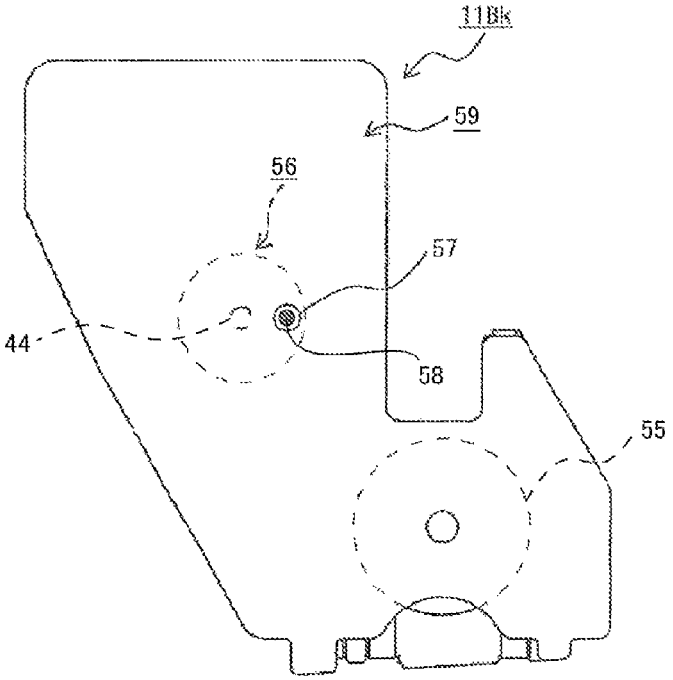
FIG. 8 is a side schematic diagram showing the image forming unit in a first state according to the embodiment of the invention.
Figure 9:
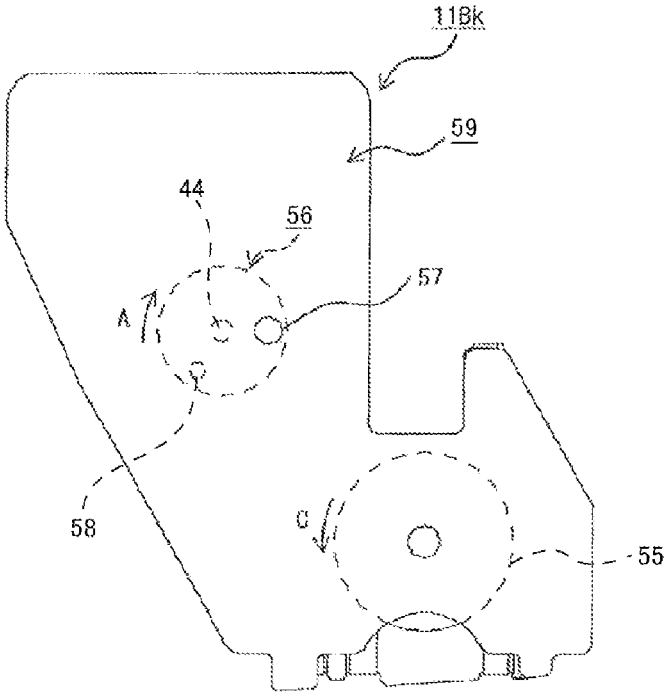
FIG. 9 is a side schematic diagram showing the image forming unit in a second state according to the embodiment of the invention.

FIG. 7 is a front view showing a driven gear according to the embodiment of the invention; FIG. 8 is a side schematic diagram showing the image forming unit in a first state according to the embodiment of the invention; FIG. 9 is a side schematic diagram showing the image forming unit in a second state according to the embodiment of the invention.

In FIGS. 7 to 9, the image forming unit 11Bk is formed with a side frame 59 of the toner container 30, the drive gear 55, and the driven gear 56. The driven gear 56 has the rotational axis 44 which is coaxial with the stirring member 43. A marker 58 is formed on a prescribed position of the driven gear 56. The side frame 59 has a hole 57 formed at a prescribed position corresponding to the position of the marker 58.

Where the image forming unit 11Bk is in the brand new state and where the stirring member 43 is placed in a way to close the toner supply opening 41, the driven gear 56 is positioned to let the operator see the marker 58 through the hole 57. Where the image forming unit 11Bk is attached to the apparatus body, and where the drive motor is driven, the drive gear 55 is rotated in Arrow C direction as shown in FIG. 9, and the driven gear 56 is rotated in Arrow A direction, thereby making the stirring member 43 not closing the toner supply opening 41, and making the operator not able to confirm the marker 58 in a ceased state through the hole 57.

The operator thus can confirm as to whether the stirring member 43 closes the toner supply opening 41, depending on whether the marker 57 is confirmed through the hole 57.

When the image forming unit 11Bk is to be manufactured, first of all, the drive motor is driven to rotate the drive gear 55 in Arrow C direction and the driven gear 56 in Arrow A direction, thereby render the marker 58 visible through the hole 57. With this position of the stirring member 43, the toner T can be filled into the toner container 30 (see FIG. 1) as in a state that the stirring member 43 closes the toner supply opening 41.

In a prior art, if toner is reserved in a toner reservoir in a brand new or unused image forming unit, the toner may be leaked out of the image forming unit when the image forming unit is attached to the apparatus body. In such a case, the leaked toner may make a mess inside the apparatus body. A know prior art such as, e.g., disclosed in Japanese Application Publication No. 2000-99894 (A1), has a structure having a shutter disposed to be open and closed at the toner supply opening; the toner supply opening is closed by the shutter so that the toner in the toner container may not come out to the toner reservoir. With such a prior art image forming unit, because the toner supply opening is normally closed with the shutter, the operator is required to open the shutter when the image forming unit is attached to the apparatus body, and such handling may be laborious.

In this embodiment, the stirring member 43 has the shielding portion 82 and the sealing members 83, 84. Where the image forming units 11Bk, 11C, 11M, 11Y are in the brand new state, the shielding portion 82 is placed at a position facing the toner supply opening 41 and shields the toner supply opening 41, and the sealing member 83 is made contacting the inner wall 38*i* of the outer frame 38 on the downstream side of the toner supply opening 41 whereas the sealing member 84 is made contacting the inner wall 38*i* of the outer frame 38 on the downstream side of the toner supply opening 41, so that the toner T in the toner container 30 is prevented from being supplied to toner hopper 37 through the gap between the outer peripheral surface 82*s* of the shielding portion 82 and the inner wall 38*i* of the outer frame 38. No toner therefore comes out of the image forming units 11Bk, 11C, 11M, 11Y, so that the apparatus body may not become dirty due to the toner.

Because the stirring member 43 is rotated in reception of the rotation from the drive motor via the reduction drive mechanism 52, a large torque is required to rotate the stirring member 43. The stirring member 43 may not be rotated even where some vibrations exert to the image forming units 11Bk, 11C, 11M, 11Y while the image forming units 11Bk, 11C, 11M, 11Y are conveyed. Accordingly, the toner T in the toner container 30 is prevented from being inadvertently supplied to the toner hopper 37.

The toner supply opening 41 is made open when the image forming units 11Bk, 11C, 11M, 11Y are attached to the apparatus body and where the stirring member 43 is rotated upon receiving the rotation from the drive motor. The operator therefore can open the toner supply opening 41 without manipulating the toner supply opening 41, thereby simplifying the work at a time that the image forming units 11Bk, 11C, 11M, 11Y are attached to the apparatus body.

The sealing members 83, 84 are provided in a bending fashion even where the gap between the outer peripheral surface 82*s* of the shielding portion 82 and the inner wall 38*i* of the outer frame 38 is changed upon exertion of, e.g., vibrations to the image forming units 11Bk, 11C, 11M, 11Y when the image forming units 11Bk, 11C, 11M, 11Y are conveyed. The sealing members 83, 84 are deformed according to changes of the gap, thereby maintaining a state that the tips 83*a*, 84*a* of the sealing members 83, 84 are in contact with the inner wall 38*i*. The toner T in the toner container 30, therefore, can be surely prevented from being supplied to the toner hopper 37 via the gap between the outer peripheral surface 82*s* of the shielding portion 82 and the inner wall 38*i* of the outer frame 38.

The sealing members 83, 84 are attached to the shielding portion 82 so that the tips 83*a*, 84*a* contact the inner wall 38*i* of the outer frame 38 in orienting the forward direction with respect to the rotation direction of the stirring member 43. The sealing members 83, 84 therefore may not disturb rotation of the stirring member 43, and renders the stirring member 43 rotate smoothly.

Although in this embodiment the printer 10 is provided with a plural number of the image forming units 11Bk, 11C, 11M, 11Y, a single image forming unit may be arranged to the printer 10.

Although in this embodiment the respective image forming units 11Bk, 11C, 11M, 11Y are mounted detachably to the apparatus body, the respective image forming units 11Bk, 11C, 11M, 11Y can be formed in a united body with the apparatus body.

Although in this embodiment two of the double gears 53, 54 are provided in the reduction drive mechanism 52 (see FIG. 5), three or more of the double gears may be provided. It is to be noted that the number of the double gears can be decided in consideration of the rotation directions of the photosensitive drum 13 and the stirring member 43.

Although in this embodiment the printer 10 is described, this invention is applicable to image forming apparatuses such as, e.g., photocopiers, LED printers, laser beam printers, facsimile machines, and MFPs (multifunction peripherals).

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An image forming unit comprising:

an image carrier;

a developer carrier carrying a developer for developing images by attaching the developer to electrostatic latent images on the image carrier;

a developer supply member for supplying the developer to the developer carrier;

a first developer container having an opening, for containing the developer;

a second developer container reserving the developer supplied via the opening from the first developer container; and a stirring member disposed rotatably in a prescribed rotation direction around a rotation axis in the first developer container for stirring the developer, wherein the stirring member comprises an arm portion (81) extending from the rotation axis towards an inner wall (38*i*) of the first developer container, a first elastic member arranged at an end of the stirring member opposite to the other end of the stirring member, at which a rotation axis of the arm portion is arranged, the first elastic member extending in a first direction, and a second elastic member arranged at the end of the stirring member, the second elastic member extending in a second direction different from the first direction, the second elastic member disposed on a downstream side of the first elastic member in the rotation direction of the stirring member.

2. The image forming unit according to claim 1, wherein the first elastic member and the second elastic member contact to the inner wall (38*i*) of the first developer container, and wherein the pushing force of the second elastic member to the inner wall of the first developer container is stronger than the pushing force of the first elastic member to the inner wall.

3. The image forming unit according to claim 1, wherein the second elastic member extends from the rotation axis to the inner wall of the first developer container, and wherein the first elastic member extends in a direction substantially perpendicular to the second elastic member.

4. The image forming unit according to claim 1, wherein each of the first and second elastic members has an area size substantially the same to one another.

5. The image forming unit according to claim 1, wherein the image carrier is driven according to drive force from a drive unit, and further comprising a first gear receiving rotational force from the drive unit, and a second gear attached to the stirring member, wherein the first and second gears are coupled through a reduction mechanism.

6. The image forming unit according to claim 5, wherein the second gear has a mark at a prescribed position thereof, and wherein the mark is recognizable from the exterior of the image forming unit through a hole formed in a housing of the image forming unit.

7. The image forming unit according to claim 1, wherein the arm portions are arranged in a plural number along an axial direction of the rotation axis, and openings (80) are arranged between the plurality of arm portions adjacent to each other.

8. The image forming unit according to claim 1, wherein an angle formed by the first elastic member and the second elastic member is between 80 and 110 degrees.

9. An image forming unit comprising:

an image carrier;

a developer carrier carrying a developer for developing images by attaching the developer to electrostatic latent images on the image carrier;

a developer supply member for supplying the developer to the developer carrier;

a first developer container having an opening, for containing the developer;

a second developer container reserving the developer supplied via the opening from the first developer container; and a stirring member disposed rotatably in a prescribed rotation direction around a rotation axis in the first developer container for stirring the developer, wherein the stirring member comprises a first elastic member extending in a first direction, and a second elastic member extending in a second direction different from the first direction, the second elastic member disposed on a downstream side of the first elastic member in the rotation direction of the stirring member, wherein the stirring member has a shielding portion, and the first elastic member is arranged to an end of the shielding portion on an upstream side in the rotation direction of the stirring member whereas the second elastic member is arranged to an end of the shielding member on a downstream side in the rotation direction of the stirring member, and wherein, where the image forming unit is in a state not yet used, the shielding portion is positioned to face the opening to shield the opening, and the first elastic member contacts the inner wall of the first developer container on a upstream side of the opening in the rotation direction of the stirring member whereas the second elastic member contacts the inner wall of the first developer container on a downstream side of the opening in the rotation direction of the stirring member.

10. The image forming unit according to claim 9, wherein the stirring member has an arm portion formed in extending radially outward from the rotation axis, and wherein the shielding portion has an outer peripheral surface extending along a trace depicted with a tip of the stirring member in the radial direction when the stirring member is rotated.

11. The image forming unit according to claim 9, wherein the stirring member has an arm portion formed in extending radially outward from the rotation axis, wherein the second elastic member extends in a direction substantially parallel to the direction that the arm portion extends, and wherein the first elastic member extends in a direction substantially perpendicular to the second elastic member.

12. The image forming unit according to claim 9, wherein the first elastic member extends in a direction substantially parallel to the direction that the shielding portion extends, and wherein the second elastic member extends in a direction substantially parallel to the direction that the arm portion extends.

13. The image forming unit according to claim 9, wherein the first and second elastic members are attached to the shielding portion so that a tip of the elastic members contacts the inner wall of the first developer container in a forward direction with respect to the rotation direction of the stirring member.

14. The image forming unit according to claim 9, wherein the shielding portion has a longer length in a longitudinal direction of the first developer container than a length of the opening, and has a wider width than a width of the opening.

15. An image forming apparatus comprising:

the image forming unit according to claim 9, and a transfer unit for conveying a medium to the image forming unit.

16. A developer containing unit comprising:

a developer container (38) reserving a developer; and a stirring member disposed rotatably in a prescribed rotation direction around a rotation axis for stirring the developer in the developer container, wherein the stirring member includes an arm portion (81) extending from the rotation axis towards an inner wall (38*i*) of the developer container, a first elastic member (83) arranged at an end of the stirring member opposite to the other end of the stirring member, at which a rotation axis of the arm portion is arranged, the first elastic member extending in a first direction, and a second elastic member arranged at the end portion of the stirring member, the second elastic member extending in a second direction different from the first direction, the second elastic member disposed on a downstream side of the first elastic member in the rotation direction of the stirring member.

17. The developer containing unit according to claim 16, wherein the arm portions are arranged in a plural number along an axial direction of the rotation axis, and openings (80) are arranged between the plurality of arm portions adjacent to each other.

18. The developer containing unit according to claim 16, wherein an angle formed by the first elastic member and the second elastic member is between 80 and 110 degrees.

19. The developer containing unit according to claim 16, wherein the first elastic member and the second elastic member contact to the inner wall (38*i*) of the first developer container, and wherein the pushing force of the second elastic member to the inner wall of the first developer container is stronger than the pushing force of the first elastic member to the inner wall.

20. An image forming apparatus comprising:

the developer containing unit according to claim 16.

* * * * *